US011270530B2

(12) United States Patent
Graves et al.

(10) Patent No.: US 11,270,530 B2
(45) Date of Patent: Mar. 8, 2022

(54) VEHICLE POSE SHARING DIAGNOSTIC SYSTEM

(71) Applicant: Caterpillar Inc., Deerfield, IL (US)

(72) Inventors: Nolan Andrew Graves, Peoria, IL (US); Paul Russell Friend, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 246 days.

(21) Appl. No.: 16/439,087

(22) Filed: Jun. 12, 2019

(65) Prior Publication Data

US 2019/0295334 A1 Sep. 26, 2019

(51) Int. Cl.
*G07C 5/00* (2006.01)
*G07C 5/08* (2006.01)

(52) U.S. Cl.
CPC ..... *G07C 5/008* (2013.01); *G07C 5/0808* (2013.01)

(58) Field of Classification Search
CPC ..... G07C 5/008; G07C 5/0808
See application file for complete search history.

(56) References Cited

U.S. PATENT DOCUMENTS 9,834,223 B2 12/2017 Jammoussi et al.
10,059,342 B2 8/2018 Ricci
2014/0358362 A1 12/2014 Breed
2015/0112505 A1* 4/2015 Collins ..... G06Q 10/04 701/1
2018/0075670 A1 3/2018 Rajakondala et al.
2018/0203130 A1 7/2018 Neubecker et al.
2018/0341273 A1 11/2018 Micks et al.
2019/0001989 A1 1/2019 Schoenfeld et al.

FOREIGN PATENT DOCUMENTS

WO 2019040651 2/2019

* cited by examiner

*Primary Examiner* — Michael V Kerrigan
(74) *Attorney, Agent, or Firm* — Harrity & Harrity LLP

(57) ABSTRACT

A vehicle pose sharing diagnostic system includes a first communication module and a first pose module in communication with the first communication module. The first pose module is configured to generate a pose signal corresponding to the first machine. The system further includes a first sensing module configured to generate a pose signal corresponding to at least one of a second machine and an infrastructure. The system includes a control module communicably coupled to the first communication module. The control module is configured to determine an operational error in the first communication module and the first pose module. The control module is also configured to generate diagnosis information corresponding to the determined operational error. Further, the system includes a feedback device communicably coupled to the control module. The feedback device is configured to receive the diagnosis information from the control module and display the diagnosis information thereon.

20 Claims, 2 Drawing Sheets

VEHICLE POSE SHARING DIAGNOSTIC SYSTEM

TECHNICAL FIELD

The present disclosure relates to a vehicle pose sharing diagnostic system for one or more machines operating at a worksite.

BACKGROUND

A machine, such as a construction machine, operating at a worksite typically includes a pose module and a communication system associated therewith. The pose module may generate signals pertaining to a current position and/or orientation of the machine whereas the communication system may allow transmission of this pose information with other machines or infrastructures present at the worksite, a back-office, or a service personnel.

The pose information may be used to assist the machine in positioning, road safety, traffic efficiency, etc. For example, the pose information that is generated by the pose module and transmitted by the communication system may be used in a collision avoidance system. As the pose module and the communication system are used to detect and transmit important machine related information, it is imperative to identify any faults in the pose module and the communication system.

U.S. Pat. No. 9,834,223 describes a system including a processor programmed to receive a first data value from a first data collector as an input to operate a first vehicle. The processor is further programmed to determine to exclude the first data value as the input to operate the first vehicle. The computer is further programmed to receive a second data value from a second data collector as the input to operate the vehicle, the second data value being provided by a source remote to the first vehicle; and actuate a first vehicle component based in part on the second data value.

SUMMARY OF THE DISCLOSURE

In an aspect of the present disclosure, a vehicle pose sharing diagnostic system associated with a first machine operating at a worksite is provided. The system includes a first communication module associated with the first machine. The system also includes a first pose module associated with the first machine and in communication with the first communication module. The first pose module is configured to generate a pose signal corresponding to the first machine. The system further includes a first sensing module associated with the first machine. The first sensing module is configured to generate a pose signal corresponding to at least one of a second machine and an infrastructure operating at the worksite. The system includes a control module communicably coupled to the first communication module. The control module is configured to determine an operational error in the first communication module and the first pose module. The control module is configured to determine the operational error based on failure in receipt of the pose signal of the first machine by at least one of the second machine and the infrastructure from the first communication module. The control module is also configured to determine the operational error based on failure in receipt of a pose signal of at least one of the second machine and the infrastructure by the first machine from the first communication module. The control module is further configured to determine the operational error based on detecting a difference between the pose signal of the first machine received from the first communication module and the pose signal of the first machine received from a second communication module associated with the first machine. The control module is configured to determine the operational error based on detecting a difference between the pose signal of at least one of the second machine and the infrastructure received from the first communication module and the pose signal of at least one of the second machine and the infrastructure received from the second communication module. The control module is configured to determine the operational error based on detecting a difference between the pose signal of the first machine detected by the first pose module and a pose signal of the first machine detected by another sensor module associated with at least one of the second machine and the infrastructure. The control module is further configured to detect the operational error based on a difference between a pose signal of at least one of the second machine and the infrastructure detected by the first sensor module and a pose signal of at least one of the second machine and the infrastructure detected by another pose module associated with at least one of the second machine and the infrastructure. The control module is also configured to generate diagnosis information corresponding to the determined operational error. Further, the system also includes a feedback device communicably coupled to the control module. The feedback device is configured to receive the diagnosis information from the control module and display the diagnosis information thereon.

Other features and aspects of this disclosure will be apparent from the following description and the accompanying drawings.

DETAILED DESCRIPTION

Figure 1:
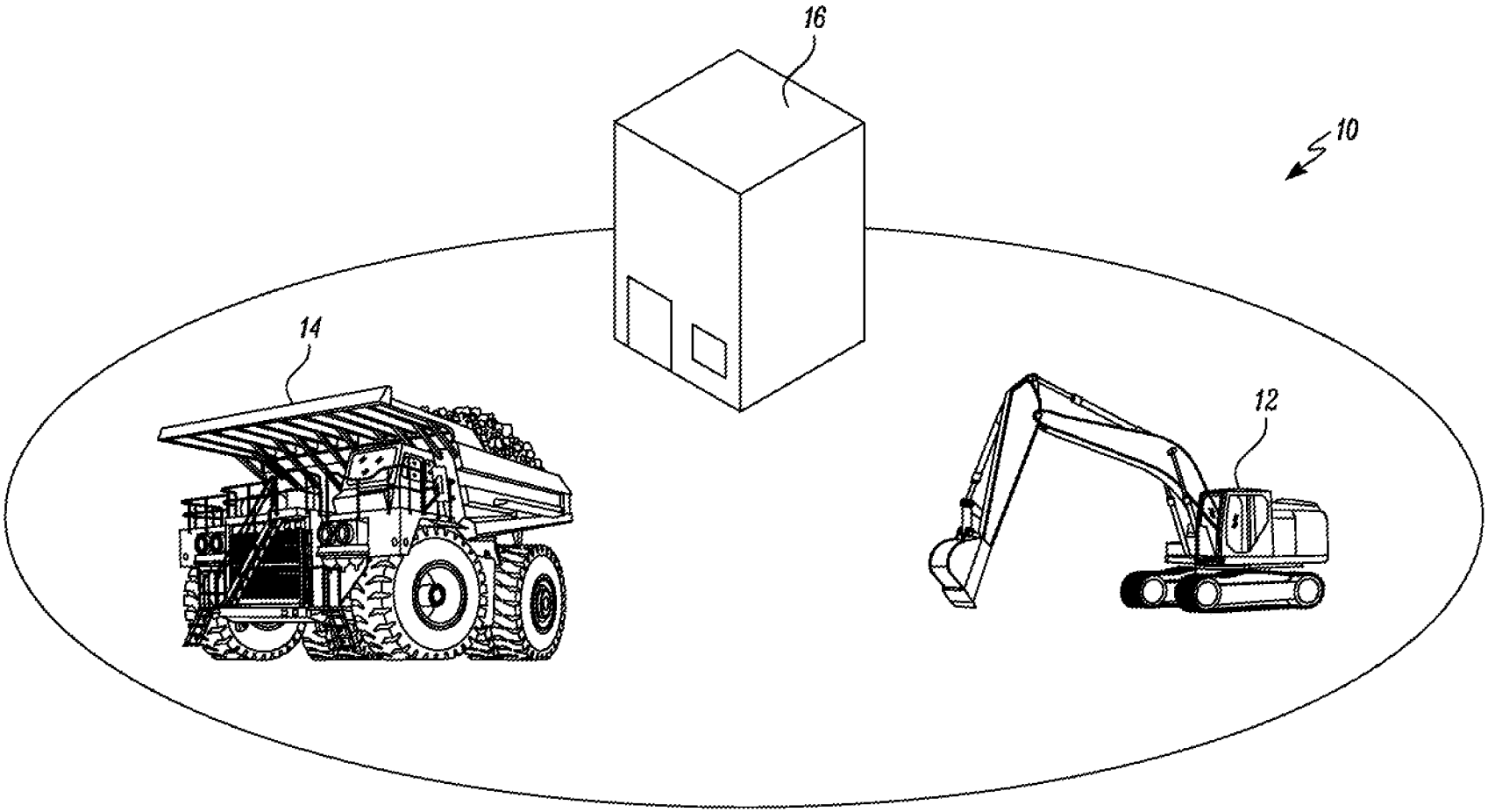
FIG. 1 is a perspective view of an exemplary worksite illustrating a first machine, a second machine, and an infrastructure, in accordance with an embodiment of the present disclosure.

Reference numerals appearing in more than one figure indicate the same or corresponding parts in each of them. References to elements in the singular may also be construed to relate to the plural and vice-versa without limiting the scope of the disclosure to the exact number or type of such elements unless set forth explicitly in the appended claims.

FIG. 1 illustrates an exemplary worksite 10. The worksite 10 may include a mining worksite. Alternatively, the worksite 10 may include any other construction worksite known in the art, without limiting the scope of the present disclosure. A number of machines 12, 14 may operate at the worksite 10. A type of the machine 12, 14 may vary based on a type of operation that needs to be performed at the worksite 10. Accordingly, the machines 12, 14 may include, but is not limited to, a haul truck, an excavator, a wheel loader, a backhoe loader, a track type tractor, a shovel, a drilling machine, a hammer, and the like. For explanatory purposes, two machines 12, 14, namely the first machine 12 and the second machine 14, are shown operating at the worksite 10, however, a total number of machines operating at the worksite 10 may vary based on system requirements.

The machines 12, 14 may be autonomous, semi-autonomous, or manually operated. When the machines 12, 14 are manual or semi-autonomous, operators seated at a back office 18 (see FIG. 2) may operate the respective machines 12, 14. The hack office 18 may be located at the worksite 10 or at a location that is distant from the worksite 10. Further, an infrastructure 16, such as a building, may also be located at the worksite 10. For exemplary purposes, only a single infrastructure 16 is illustrated herein. However, the worksite 10 may include multiple infrastructures, as per requirements.

Further, a first communication module 20 is associated with the first machine 12. The first communication module 20 may allow sending and receiving of pose signals between the first machine 12, the second machine 14, and the infrastructure 16. Further, the first machine 12 may also include a second communication module 24 that operates independent from the first communication module 20. The second communication module 24 may allow sending and receiving of pose signals between the first machine 12, the second machine 14, and the infrastructure 16. The second communication module 24 may use Wi-Fi, satellite, or cellular communication to send and receive information.

Moreover, a first pose module 22 is associated with the first machine 12. The first pose module 22 may be disposed on the first machine 12. The first pose module 22 is in communication with the first communication module 20. The first pose module 22 generates a pose signal. The pose signal may include any one of a current position, an orientation, and/or time derivatives thereof corresponding to the first machine 12. In an example, the first pose module 22 may include any one of a Global Navigation Satellite System (GNSS) device, Inertial Measurement Unit (IMU), odometer device, LIDAR, RADAR, and the like.

Further, a first sensor module 46 is associated with the first machine 12. The first sensor module 46 may include one or more perception sensors. In various examples, the perception sensors of the first sensor module 46 may generate a pose signal. The pose signal may include any one of a current position, all orientation, and/or time derivatives thereof corresponding to other machines and infrastructures present at the worksite 10. For example, the perception sensors may generate pose signals corresponding to the second machine 14 and/or infrastructure 16. In an example, each of the first communication module 20, the first pose module 22, the second communication module 24, and the first sensor module 46 may be communicably coupled to a first control module 38 that may be present onboard the first machine 12. It should be noted that the pose signal generated by the first pose module 22 may be transmitted to the back office 18 as well as other machines and infrastructures at the worksite 10, via each of the first communication module 20 and the second communication module 24.

The second machine 14 includes a third communication module 26 associated with the second machine 14. The third communication module 26 may allow sending and receiving of pose signals between the first machine 12, the second machine 14, and the infrastructure 16. Further, the second machine 14 may also include a fifth communication module 52 that operates independent from the third communication module 26. The fifth communication module 52 may allow sending and receiving of pose signals between the first machine 12, the second machine 14, and the infrastructure 16. The fifth communication module 52 may use Wi-Fi, satellite, or cellular communication to send and receive information.

Moreover, a second pose module 28 is associated with the second machine 14. The second pose module 28 may be disposed on the second machine 14. The second pose module 28 is in communication with the third communication module 26. The second pose module 28 generates a pose signal. The pose signal may include any one of the current position, the orientation, and/or time derivatives thereof corresponding to the second machine 14. In an example, the second pose module 28 may include any one of a GNSS device, IMU, odometer device, LIDAR, RADAR, and the like. Further, a second sensor module 48 is associated with the second machine 14. The second sensor module 48 may include one or more perception sensors. In various examples, the perception sensors of the second sensor module 48 may generate pose signals corresponding to a pose signal. The pose signal may include any one of a current position, an orientation, and/or time derivatives thereof corresponding to other machines and infrastructures present at the worksite 10. For example, the perception sensors may generate pose signals corresponding to the first machine 12 and the infrastructure 16.

In an example, each of the third communication module 26, the second pose module 28, and the second sensor module 48 may be communicably coupled to a second control module 40 that may be present onboard the second machine 14. It should be noted that the signals generated by the second pose module 28 may be transmitted to the back office 18, the first machine 12, the infrastructure 16, as well as other machines and infrastructures at the worksite 10, via the third communication module 26.

Further, the infrastructure 16 includes a fourth communication module 30 associated with the infrastructure 16. The fourth communication module 30 may allow sending and receiving of pose signals between the first machine 12, the second machine 14, and the infrastructure 16. Further, the infrastructure 16 may also include a sixth communication module 54 that operates independent from the fourth communication module 30. The sixth communication module 54 may allow sending and receiving of pose signals between the first machine 12, the second machine 14, and the infrastructure 16. The sixth communication module 54 may use Wi-Fi, satellite, or cellular communication to send and receive information.

Moreover, a third pose module 32 is associated with the infrastructure 16. The third pose module 50 may be disposed on the infrastructure 16. The third pose module 32 is in communication with the fourth communication module 30. The third pose module 32 generates a pose signal. The pose signal may include any one of the current position, the orientation, and/or time derivatives thereof corresponding to the infrastructure 16. In an example, the third pose module 32 may include any one of a GNSS device, IMU, odometer device, LIDAR, RADAR, and the like. Further, a third sensor module 50 is associated with the infrastructure 16. The third sensor module 50 may include one or more perception sensors. In various examples, the perception sensors of the third sensor module 50 may generate pose signals corresponding to the current position, the orientation, and/or time derivatives thereof corresponding to other machines and infrastructures present at the worksite 10. For example, the perception sensors may generate pose signals corresponding to the first machine 12 and the second machine 14.

In an example, each of the fourth communication module 30, the third pose module 32, and the third sensor module 50 may be communicably coupled to a third control module 42 that may be present onboard the infrastructure 16. It should be noted that the signals generated by the third pose module 32 may be transmitted to the back office 18, the first machine 12, the second machine 14, as well as other machines and infrastructures at the worksite 10, from the fourth communication module 30.

Each of the communication modules 20, 26, 30 may employ radio based, WLAN-based, or cellular-based communication techniques to send and receive various information related to the first machine 12, the second machine 14, and the infrastructure 16. The communication modules 20, 26, 30 associated with each of the machines 12, 14 and the infrastructure 16 may allow the machines 12, 14 and the infrastructure 16 to communicate with each other and with the back office 18. Such communication modules 20, 26, 30 are imperative when the machines 12, 14 operate in an autonomous mode as the data exchanged through the communication modules 20, 26, 30 may be used in systems that allow efficient machine operation, such as in a collision avoidance system.

As the communication modules 20, 26, 30 relay useful pose related information of the machines 12, 14 and the infrastructure 16, it is important to detect any errors in such communication modules 20, 26, 30. Further, it is also important to detect any errors in the first, second, and third pose modules 22, 28, 32 associated with the machines 12, 14 and the infrastructure 16, respectively. More particularly, the signals generated by the pose modules 22, 28, 32 may be used in various systems that are employed to allow efficient machine operation at the worksite 10. Thus, any errors in the communication modules 20, 26, 30 or the pose modules 22, 28, 32 may cause incorrect relay of information or no relay of information, which is not desirable and may impact a productivity at the worksite 10.

Figure 2:
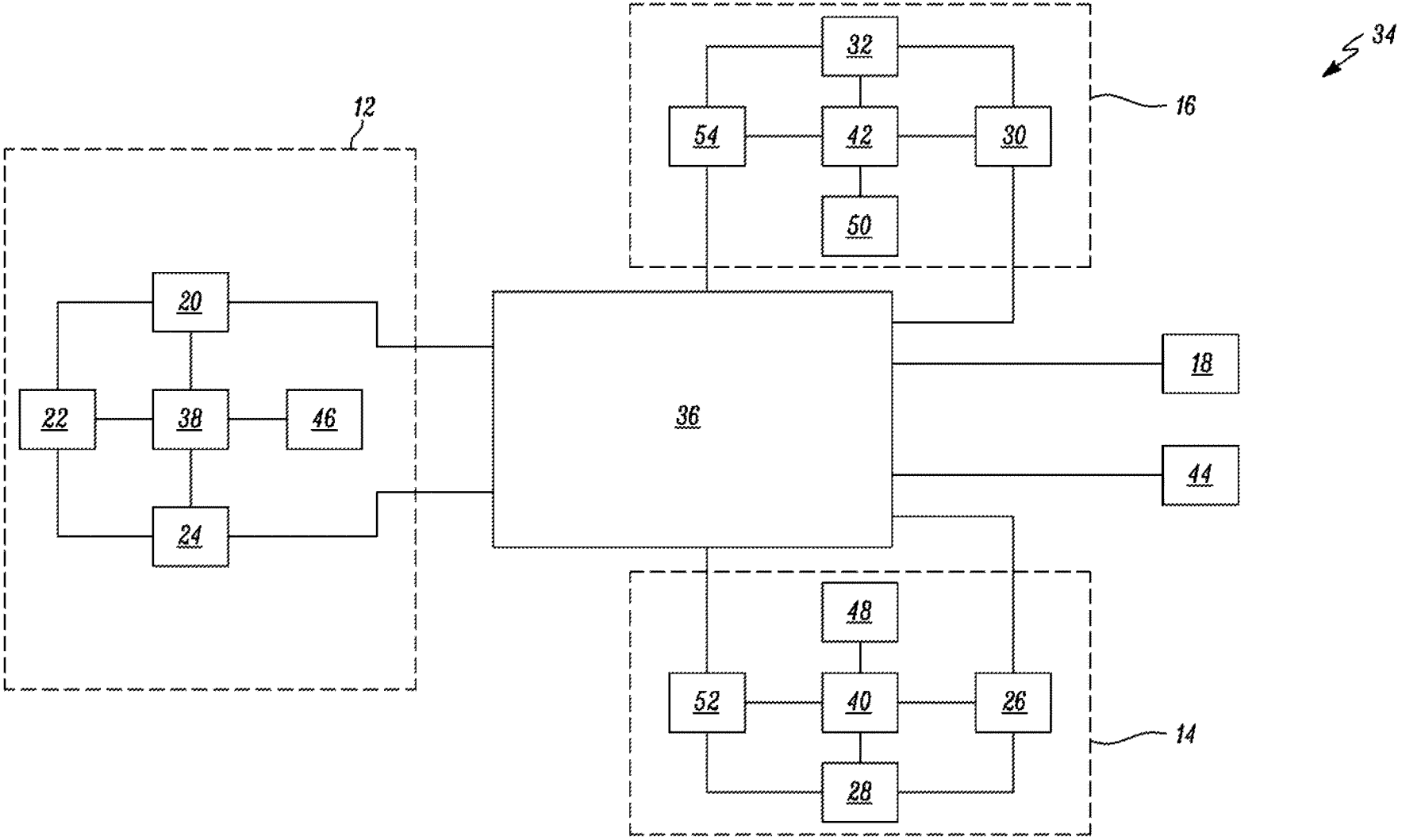
FIG. 2 is a block diagram of a vehicle pose sharing diagnostic system associated with the first machine operating at the worksite, in accordance with an embodiment of the present disclosure.

Referring to FIG. 2, the present disclosure is directed towards a vehicle pose sharing diagnostic system 34 associated with the first machine 12 operating at a worksite 10. More particularly, the system 34 is used for diagnosing the first communication module 20 and the first pose module 22 associated with the first machine 12. The vehicle pose sharing diagnostic system 34 is hereinafter interchangeably referred to as the system 34. Although the present disclosure is described in relation to the diagnosis of components associated with the first machine 12. The teachings of the present disclosure may be applied to diagnosis of components associated with the second machine 14, the infrastructure 16, or any other machine/infrastructure present at the worksite 10, without any limitations.

The system 34 includes the first communication module 20 associated with the first machine 12. Further, the system 34 includes the first pose module 22 that is in communication with the first communication module 20. Moreover, the system 34 includes a control module 36. The control module 36 is communicably coupled to each of the first communication module 20, the second communication module 24, the third communication module 26, the fifth communication module 52, the fourth communication module 30, and the sixth communication module 54.

Further, the control module 36 determines an operational error in the first communication module 20 and the first pose module 22. Moreover, the control module 36 generates diagnosis information corresponding to the determined operational error in the first communication module 20 and the first pose module 22. The control module 36 determines the operational error in the first communication module 20 and the first pose module 22 based on a number of factors. The various factors for determining the operational error in the first communication module 20 will now be explained in detail.

As a first factor, the control module 36 determines the operational error in the first communication module 20 based on a failure in receipt of the pose signal of the first machine 12 by the second machine 14 and/or infrastructure 16 from the first communication module 20. More particularly, when the first communication module 20 is operating, the third and/or fourth communication modules 26, 30 may receive the pose signal of the first machine 12 from the first communication module 20. Hence, non-receipt of the pose signal by the third and/or fourth communication modules 26, 30 may indicate a possible error with the first communication module 20.

In one example, the fifth and/or sixth communication modules 52, 54 may receive the pose signal of the first machine 12 from the second communication module 24, but the third and/or fourth communication module 26, 30 may not receive the pose signal of the first machine 12 from the first communication module 20. In such an example, the second and/or third control modules 40, 42 may detect such non-receipt of the pose signal from the first communication module 20 and may indicate the operational error in the first communication module 20.

In another example, the second and/or third sensor modules 48, 50 may detect the pose of the first machine 12 using perception sensors, however, the third and/or fourth communication modules 26, 30 may not receive the pose signal of the first machine 12 from the first communication module 20. In such an example, the second and/or third control modules 40, 42 may detect such non-receipt of the pose signal from the first communication module 20 and may indicate the operational error in the first communication module 20.

Accordingly, the second and/or third control modules 40, 42 may send a signal to the control module 36 indicating the operational error in the first communication module 20. Further, the control module 36 determines the operational error in the first communication module 20 based on the signal received from the second and/or third control modules 40, 42. Subsequently, the control module 36 generates diagnosis information indicative of the determined operational error in the first communication module 20. In some examples, the diagnosis information may be indicative of one or more errors in the first communication module 20 because of which the first communication module 20 may not be able to send and receive information.

It should be further noted that, in some examples, if the third and/or fourth communication modules 26, 30 do not receive the pose signal from the first communication module 20, the second and/or third control modules 40, 42 may indicate an error in the third and/or fourth communication modules 26, 30. In such examples, the second and/or third control modules 40, 42 may determine if the third and/or fourth communication modules 26, 30 are receiving pose signals from other machines or infrastructures at the worksite 10. If the third and/or fourth communication modules 26, 30 are receiving pose signals from other machines or infrastructures, the second and/or third control modules 40, 42 may indicate that the first communication module 20 is faulty. However, if the third and/or fourth communication modules 26, 30 are not receiving pose signals from other machines or infrastructures, the second and/or third control modules 40, 42 may indicate that the third and/or fourth communication modules 26, 30 are faulty.

As a second factor, the control module 36 determines the operational error based on a failure in receipt of the pose signals of the second machine 14 and/or infrastructure 16 by the first machine 12 from the first communication module 20. More particularly, when the first communication module 20 is operating, the first communication module 20 may receive the pose signals of the second machine 14 and/or infrastructure 16 from the third and fourth communication modules 26, 30. Hence, non-receipt of the pose signals by the first communication module 20 may indicate a possible error with the first communication module 20.

In one example, the second communication module 24 may receive the pose signals of the second machine 14 and/or infrastructure 16 from the fifth and sixth communication modules 52, 54, but the first communication module 20 may not receive the pose signals of second machine 14 and/or infrastructure 16 from the third and/or fourth communication module 26, 30. In such an example, the first control module 38 may detect such non-receipt of the pose signals from the first communication module 20 and may indicate the operational error in the first communication module 20.

In another example, the first sensor module 48 may detect the pose of the second machine 14 and/or infrastructure 16 using perception sensors, however, the first communication module 20 may not receive the pose signals of the second machine 14 and/or the infrastructure 16 from the third and/or fourth communication modules 26, 30. In such an example, the first control module 38 may detect such non-receipt of the pose signals from the first communication module 20 and may indicate the operational error in the first communication module 20.

Accordingly, the first control module 38 may send a signal to the control module 36 indicating the operational error in the first communication module 20. It should be noted that the signal indicating the operational error in the first communication module 20 may be sent to the control module 36 from the second communication module 24 or any other communication route such as Wi-Fi, satellite, cellular communication, etc. as the control module 36 may not receive the signals sent via the first communication module 20 if the first communication module 20 is faulty.

Further, the control module 36 determines the operational error in the first communication module 20 based on the signal received from the first control module 38. Subsequently, the control module 36 generates diagnosis information indicative of the determined operational error in the first communication module 20. In some examples, the diagnosis information may be indicative of one or more errors in the first communication module 20 because of which the first communication module 20 may not be able to send and receive information.

It should be further noted that, in some examples, if the first communication module 20 does not receive the pose signals from the third and/or fourth communication modules 26, 30, the first control module 38 may indicate an error in the third and/or fourth communication modules 26, 30. In such examples, the first control module 38 may determine if the first communication module 20 is receiving pose signals from other machines or infrastructures at the worksite 10. If the first communication module 20 is receiving pose signals from other machines or infrastructures, the first control module 38 may indicate that the third and/or fourth communication modules 26, 30 are faulty. However, if the first communication module 20 is not receiving pose signals from other machines or infrastructures, the first control module 38 may indicate that the first communication module 20 is faulty.

As a third factor, the control module 36 determines the operational error in the first communication module 20 based on detection of a difference between the pose signal of the first machine 12 received from the first communication module 20 and the pose signal of the first machine 12 received from the second communication module 24. More particularly, the second and/or third control modules 40, 42 may receive the pose signal of the first machine 12 from the first communication module 20. Further, the second and/or third control modules 40, 42 may also receive the pose signal of the first machine 12 from the second communication module 24. When the first communication module 20 is operating, the pose signal of the first machine 12 received from the first communication module 20 may be in sync with the pose signal of the first machine 12 received from the second communication module 24. However, if the second and/or third control modules 40, 42 receives erroneous signals pertaining to the pose of the first machine 12 from the first communication module 20, the second and/or third control modules 40, 42 may indicate a possible error with the first communication module 20.

In some examples, the second and/or third control modules 40, 42 may compare the pose signal pertaining to the first machine 12 received from the first and second communication modules 20, 24 with the pose signal pertaining to the first machine 12 received from the second and/or third sensor modules 48, 50. If the pose signal received from the first communication module 20 is not in sync with the pose signals received from the second and/or third sensor modules 48, 50, the second and/or third control modules 40, 42 determines the operational error in the first communication module 20. If the pose signal received from the second communication module 24 is not in sync with the pose signals received from the second and/or third sensor modules 48, 50, the second and/or third control modules 40, 42 determines the operational error in the second communication module 24.

If the second and/or third control modules 40, 42 detects the fault in the first communication module 20, the second and/or third control modules 40, 42 may send a signal to the control module 36 indicating the operational error in the first communication module 20. Further, the control module 36 determines the operational error in the first communication module 20 based on the signal received from the second and/or third control modules 40, 42. Subsequently, the control module 36 generates diagnosis information indicative of the determined operational error in the first communication module 20. In some examples, the diagnosis information may be indicative of one or more errors in the first communication module 20 because of which the first communication module 20 may not be able to send and receive information.

As a fourth factor, the control module 36 determines the operational error in the first communication module 20 based on detection of a difference between the pose signals of the second machine 14 and/or infrastructure 16 received from the first communication module 20 and the pose signals of the second machine 14 and/or infrastructure 16 received from the second communication module 24. More particularly, when the first communication module 20 is operating, the pose signals of the second machine 14 and/or infrastructure 16 received by the first control module 38 from the first communication module 20 may be in sync with the pose signals of the second machine 14 and/or infrastructure 16 received by the first control module 38 from the second communication module 24. If the first control module 38 receives erroneous signals pertaining to the pose of the second machine 14 and/or infrastructure 16 from the first communication module 20, the first control module 38 may indicate a possible error with the first communication module 20.

In an example, the first control module 38 may compare the pose signals pertaining to the second machine 14 and/or infrastructure 16 received from the first and second communication modules 20, 24, with the pose signals pertaining to the second machine 14 and/or infrastructure 16 received from the first sensor module 46. If the pose signals of the second machine 14 and/or infrastructure 16 received from the first communication module 20 are not in sync with the pose signals detected by the first sensor module 46, the first control module 38 determines the operational error in the first communication module 20. However, if the pose signals of the second machine 14 and/or infrastructure 16 received from the second communication module 24 are not in sync with the pose signals detected by the first sensor module 46, the first control module 38 determines the operational error in the second communication module 24.

If the first control module 38 detects the fault in the first communication module 20, the first control module 38 may send a signal to the control module 36 indicating the operational error in the first communication module 20. It should be noted that the signal indicating the operational error in the first communication module 20 may be sent to the control module 36, via the second communication module 24 or any other communication route such as Wi-Fi, satellite, cellular communication, etc. Subsequently, the control module 36 generates diagnosis information indicative of the determined operational error in the first communication module 20. In some examples, the diagnosis information may be indicative of one or more errors in the first communication module 20 because of which the first communication module 20 may not be able to send and receive information.

Further, the control module 36 also determines the operational error in the first pose module 22. The various factors for determining the operational error in the first pose module 22 will now be explained in detail. As a first factor, the control module 36 determines the operational error in the first pose module 22 based on detecting a difference between the pose signal detected by the first pose module 22 and the pose signal of the first machine 12 detected by the second and/or third sensor modules 48, 50 associated with the second machine 14 and infrastructure 16, respectively. More particularly, when the first pose module 22 is operating, the pose signal of the first machine 12 generated by the first pose module 22 may be in sync with the pose signal of the first machine 12 detected by the second and/or third sensor modules 48, 50. If the pose signal of the first machine 12 generated by the first pose module 22 is not in sync with the pose signal of the first machine 12 detected by the second and/or third sensor modules 48, 50, the second and/or third control modules 40, 42 may indicate a possible error with the first pose module 22.

Accordingly, the second and/or third control modules 40, 42 may send the signal to the control module 36 indicating the operational error in the first pose module 22. It should be noted that the signal indicating the operational error in the first pose module 22 may be sent to the control module 36 via any communication route such as Wi-Fi, satellite, cellular communication, etc. Subsequently, the control module 36 generates diagnosis information indicative of the determined operational error in the first pose module 22. In some examples, the diagnosis information may be indicative of one or more errors in the first pose module 22 because of which the first pose module 22 may relay the faulty pose signal.

It should be further noted that, in some examples, if the pose signal of the first machine 12 generated by the first pose module 22 is not in sync with the pose signal of the first machine 12 detected by the second and/or third sensor modules 48, 50, the second and/or third control modules 40, 42 may indicate a possible error with one of the second and third sensor modules 48, 50 or one of the second and third pose modules 28, 32. In such examples, the first control module 38 may process pose signals for the first machine 12 received from multiple/redundant perception sensors to determine if the fault lies in the first pose module 22, one of the second and third sensor modules 48, 50, or one of the second and third pose modules 28, 32.

As a second factor, the control module 36 determines the operational error in the first pose module 22 based on detecting a difference between the pose signals of the second machine 14 and/or infrastructure 16 detected by the first sensor module 48 and the pose signals of the second machine 14 and/or infrastructure 16 detected by the second and/or third pose modules 28, 32 associated with the second machine 14 and infrastructure 16, respectively. More particularly, when the first pose module 22 is operating, the pose signals of the second machine 14 and/or infrastructure 16 generated by the first sensor module 48 may be in sync with the pose signals of the second machine 14 and/or infrastructure 16 detected by the second and/or third pose modules 28, 32. If the pose signals of the second machine 14 and/or infrastructure 16 generated by the first sensor module 48 is not in sync with the pose signals of the second machine 14 and/or infrastructure 16 detected by the second and/or third pose modules 28, 32, the first control module 38 may indicate a possible error with the first pose module 22.

Accordingly, the first control module 38 may send the signal to the control module 36 indicating the operational error in the first pose module 22. It should be noted that the signal indicating the operational error in the first pose module 22 may be sent to the control module 36 via any communication route such as Wi-Fi, satellite, cellular communication, etc. Subsequently, the control module 36 generates diagnosis information indicative of the determined operational error in the first pose module 22. In some examples, the diagnosis information may be indicative of one or more errors in the first pose module 22 because of which the first pose module 22 may relay the faulty pose signal.

It should be further noted that, in some examples, if the pose signals of the second machine 14 and/or infrastructure 16 generated by the first sensor module 48 is not in sync with the pose signals of the second machine 14 and/or infrastructure 16 detected by the second and/or third pose modules 28, 32, the first control module 38 may indicate a possible error with the second and/or third pose modules 28, 32 or the first sensor module 48. In such examples, the first control module 38 may process pose signals for the second machine 14 and/or infrastructure 16 received from multiple/redundant perception sensors to determine if the fault lies in the first pose module 22, the second and/or third pose modules 28, 32, or the first sensor module 48.

It should be noted that in some examples, functionalities of the first, second, and third control modules 38, 40, 42 may be performed by the control module 36, such that the system 34 includes a single central control module 36 that determines the operational errors and generates the diagnosis information, without any limitations. In such examples, the control module 36 may be communicably coupled to each of the pose modules 22, 28, 32 and the sensor modules 46, 48, 50 to receive the pose signals therefrom.

Further, the control modules 36, 38, 40, 42 may embody a single microprocessor or multiple microprocessors that include components for performing functions that are consistent with the present disclosure. Numerous commercially available microprocessors can be configured to perform the functions of the control modules 36, 38, 40, 42 disclosed herein. It should be appreciated that the control modules 36, 38, 40, 42 could readily be embodied in a general machine microprocessor capable of controlling numerous machine functions. The control modules 36, 38, 40, 42 may also include a memory and any other components for running an application. Various circuits may be associated with the control modules 36, 38, 40, 42 such as power supply circuitry, signal conditioning circuitry, solenoid driver circuitry, and other types of circuitry. Also, various routines, algorithms, and/or programs can be stored at the control modules 36, 38, 40, 42 for determining the operational error.

Further, the system 34 includes a feedback device 44 communicably coupled to the control module 36. The feedback device 44 receives the diagnosis information from the control module 36 and displays the diagnosis information thereon. The feedback device 44 may be present at the back office 18, such that the diagnosis information may alert a personnel regarding the operational error in one of the communication modules 20, 26, 30 or the pose module 22, 28, 32. Further, the diagnosis information may be relayed to a service personnel, via the back office 18, so that faulty machine components may be repaired. In some examples, the feedback device 44 may be present with the service personnel so that the service personnel receives a real time update of any faults in the communication modules 20, 26, 30 or the pose modules 22, 28, 32.

The feedback device 44 may embody a display device such as a monitor, a handheld/portable device such as a tablet or a smartphone, or any other known device having a screen that provides visual output pertaining to the diagnosis information. In such an example, the feedback device 44 may display a visual notification, such as a text message, to alert the personnel regarding the diagnosis information. Alternatively, the feedback device 44 may include speakers that provide audio output. In such an example, the notification may include an audio notification for alerting the personnel regarding the diagnosis information, without any limitations.

Further, when the control module 36 determines the operational error in the first communication module 20, the control module 36 may send the diagnosis information generated to the first machine 12, via the second communication module 24. Moreover, when the control module 36 determines the operational error in the first pose module 22, the control module 36 may send the diagnosis information generated to the first machine 12, via the first or second communication module 20, 24. The diagnosis information may be displayed on a feedback device mounted in an operator cab of the first machine 12 to notify the operator of the first machine 12 regarding the operational error. Alternatively, when the control module 36 determines the operational error in the third communication module 26, the control module 36 may send the diagnosis information to the second machine 14, via communication routes such as Wi-Fi, satellite, and cellular communication. Moreover, when the control module 36 determines the operational error in the second pose module 28, the control module 36 may send the diagnosis information generated to the first machine 12, via the third communication module 26 or other communication routes. Accordingly, the diagnosis information may be displayed on a feedback device mounted in an operator cab of the second machine 14.

Additionally, when the control module 36 determines the operational error in the fourth communication module 30, the control module 36 may send the diagnosis information to the infrastructure 16, via communication routes such as Wi-Fi, satellite, and cellular communication. Moreover, when the control module 36 determines the operational error in the third pose module 32, the control module 36 may send the diagnosis information generated to the infrastructure 16, via the fourth communication module 40 or other communication routes. Accordingly, the diagnosis information may be displayed on a feedback device mounted at the infrastructure 16.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure relates to the vehicle pose sharing system 34 for diagnosing communication modules and/or pose modules of one or more first machines, infrastructures, and second machines operating at the worksite 10. More particularly, the system 34 indicates any error in the operation of the communication modules 20, 26, 30 and the pose modules 22, 28, 32 associated with the first machine 12, the second machine 14, and the infrastructure 16. The system 34 described herein is simple in operation and provides a cost effective solution as the system 34 uses components that are already associated with the first machine 12, the second machine 14, and the infrastructure 16 for diagnosis. More particularly, in some examples, the system 34 uses perception sensors that are already mounted on the machines 12, 14 and the infrastructure 16 for determining operational errors in the communication modules 20, 26, 30 and the pose modules 22, 28, 32. Further, the system 34 reduces a possibility of collision of the machines 12, 14 with each other or with the infrastructure 16 due to incorrect pose signals that may be relayed if one of the communication modules 20, 26, 30 or the pose modules 22, 28, 32 encounter any error in operation.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A system associated with a first machine operating at a worksite, the system comprising:

a first communication module associated with the first machine;

a first pose module associated with the first machine and in communication with the first communication module;

a first sensing module associated with the first machine;

a control module communicably coupled to the first communication module, wherein the control module is configured to:

determine an operational error in at least one of the first communication module or the first pose module based on at least one of:

detecting a difference between a first pose signal of the first machine received from the first communication module and a second pose signal of the first machine received from a second communication module associated with the first machine;

detecting a difference between one or more first pose signals of at least one of a second machine or an infrastructure received from the first communication module and one or more second pose signals of at least one of the second machine or the infrastructure received from the second communication module;

detecting a difference between a third pose signal of the first machine detected by the first pose module and a fourth pose signal of the first machine detected by a second sensing module associated with at least one of the second machine or the infrastructure; or detecting a difference between one or more third pose signals of at least one of the second machine or the infrastructure detected by the first sensing module and one or more fourth pose signals of at least one of the second machine or the infrastructure detected by a second pose module associated with at least one of the second machine or the infrastructure; and generate diagnosis information corresponding to the operational error; and a feedback device communicably coupled to the control module, wherein the feedback device is configured to receive the diagnosis information from the control module and provide, for display, the diagnosis information.

2. The system of claim 1, wherein the operational error is determined based on detecting the difference between the first pose signal of the first machine received from the first communication module and the second pose signal of the first machine received from the second communication module.

3. The system of claim 2, wherein the operational error indicates an error with the first communication module.

4. The system of claim 1, wherein the operational error is determined based on detecting the difference between the one or more first pose signals of at least one of the second machine or the infrastructure received from the first communication module and the one or more second pose signals of at least one of the second machine or the infrastructure received from the second communication module.

5. The system of claim 1, wherein the operational error is determined based on detecting the difference between the third pose signal of the first machine detected by the first pose module and the fourth pose signal of the first machine detected by the second sensing module.

6. The system of claim 5, wherein the operational error indicates an error with the first pose module.

7. The system of claim 1, wherein the operational error is determined based on detecting the difference between the one or more third pose signals of at least one of the second machine or the infrastructure detected by the first sensing module and the one or more fourth pose signals of at least one of the second machine or the infrastructure detected by the second pose module.

8. The system of claim 1, wherein the control module is further configured to:

send the diagnosis information via the second communication module when the operation error is determined in the first communication module.

9. The system of claim 1, wherein the diagnosis information is provided for display on the feedback device.

10. The system of claim 1, wherein the feedback device is mounted in an operator cab of the first machine.

11. The system of claim 1, wherein the first sensing module includes one or more perception sensors.

12. The system of claim 1, wherein the one or more first pose signals of at least one of the second machine or the infrastructure includes information regarding a current position, an orientation, or one or more time derivatives corresponding to the second machine or the infrastructure.

13. The system of claim 1, wherein the second pose module includes one of a Global Navigation Satellite System (GNSS) device, Inertial Measurement Unit (IMU), odometer device, light detection and ranging (LIDAR), or radio detection and ranging (RADAR).

14. The system of claim 1, wherein the operational error is determined further based on a failure in receipt of the first pose signal of the first machine by the second machine from the first communication module.

15. The system of claim 1, wherein the operational error is determined further based on a failure in receipt of the one or more first pose signals of at least one of the second machine or the infrastructure from the first communication module.

16. A method comprising:

determining, by one or more processors, an operational error in at least one of a first communication module or a first pose module based on at least one of:

detecting a difference between a first pose signal of a first machine received from a first communication module and a second pose signal of the first machine received from a second communication module, detecting a difference between one or more first pose signals of at least one of a second machine or an infrastructure received from the first communication module and one or more second pose signals of at least one of the second machine or the infrastructure received from the second communication module, detecting a difference between a third pose signal of the first machine detected by a first pose module and a fourth pose signal of the first machine detected by a second sensing module associated with at least one of the second machine or the infrastructure, or detecting a difference between one or more third pose signals of at least one of the second machine or the infrastructure detected by a first sensing module associated with the first machine and one or more fourth pose signals of at least one of the second machine or the infrastructure detected by a second pose module associated with at least one of the second machine or the infrastructure;

generating, by the one or more processors, diagnosis information corresponding to the operational error; and providing, by the one or more processors, the diagnosis information.

17. The method of claim 16, wherein the operational error is determined based on detecting the difference between the first pose signal of the first machine received from the first communication module and the second pose signal of the first machine received from the second communication module.

18. The method of claim 16, wherein the operational error is determined further based on a failure in receipt of the first pose signal of the first machine by the second machine from the first communication module.

19. A system comprising:

a first communication module associated with a machine; and a control module communicably coupled to the first communication module, wherein the control module is configured to:

determine an operational error in the first communication module based on at least a difference between a first pose signal of the machine received from the first communication module and a second pose signal of the machine received from a second communication module associated with the machine;

generate information corresponding to the operational error; and provide the information corresponding to the operational error.

20. The system of claim 19, wherein the pose signal indicates information regarding one or more of a current position, an orientation, or one or more time derivatives corresponding to the machine.

* * * * *